United States Patent [19]

Long, Jr.

[11] Patent Number: 5,074,528

[45] Date of Patent: Dec. 24, 1991

[54] REDUNDANT CRANE REEVING APPARATUS

[75] Inventor: Herbert D. Long, Jr., West Allis, Wis.

[73] Assignee: Harnischfeger Corporation, Brookfield, Wis.

[21] Appl. No.: 375,061

[22] Filed: Jul. 3, 1989

[51] Int. Cl.[5] ..... B66D 1/26

[52] U.S. Cl. ..... 254/285; 254/290

[58] Field of Search ..... 254/283, 284, 285, 286, 254/290, 291, 292, 324

[56] References Cited

U.S. PATENT DOCUMENTS

| | | | |
|---|---|---|---|
| 4,094,493 | 6/1978 | Poler | 254/285 |
| 4,214,664 | 7/1980 | Poler | 254/285 |

FOREIGN PATENT DOCUMENTS

| | | | |
|---|---|---|---|
| 1207584 | 12/1965 | Fed. Rep. of Germany | 254/285 |
| 1266468 | 4/1968 | Fed. Rep. of Germany | 254/285 |
| 2038942 | 2/1972 | Fed. Rep. of Germany | 254/286 |
| 0033458 | 3/1979 | Japan | 254/285 |

*Primary Examiner*—Katherine Matecki

*Attorney, Agent, or Firm*—Richard C. Ruppin

[57] ABSTRACT

A reeving apparatus for a crane hoist is disclosed as having an overhead frame, a lifting beam positioned below the frame and carrying a plurality of rotatable lifting beam sheaves, and load carrying means suspended from the lifting beam. A plurality of ropes are also provided for supporting the lifting beam and load carrying means with each one of the plurality of ropes being wrapped around at least one of the plurality of lifting beam sheaves. A pair of rotatable drums are mounted on the overhead frame with the first drum being connected to the plurality of ropes for raising and lowering the lifting beam and the second drum also being connected to the plurality of ropes for raising and lowering the lifting beam. Although both drums are connected to the plurality of ropes, they are operable independently of each other to raise and lower the lifting beam in the event of inoperability of either drum. Further, the pair of rotatable drums have normal condition in which both are rotatably operable together to raise and lower the lifting beam.

2 Claims, 4 Drawing Sheets

REDUNDANT CRANE REEVING APPARATUS

FIELD OF THE INVENTION

This invention relates to a crane reeving apparatus having a plurality of separate ropes and two independently rotatable rope winding drums. In particular, the invention relates to a crane reeving apparatus which is operable with either one of two winding drums and with less than all of a plurality of ropes.

BACKGROUND OF THE INVENTION

In some crane applications, it is desirable that the crane be capable of performing load lifting and raising operations even though some of the components of the reeving and hoist apparatus of the crane are inoperative. Those cranes which provide this operating capability frequently use a redundant hoist system in which all, or substantially all, of the major reeving and hoist components are duplicated. In effect, entirely two separate reeving systems may be incorporated in the crane so that one reeving system can be used in the event of failure of the other. This, of course, is a very expensive approach and also results in a hoist and reeving arrangement which occupies a large amount of space. In turn, the large space of the hoist and reeving apparatus increases the size and weight of the frame on which they are supported. Where a lifting beam is used as part of the hoist, it may also be necessary to enlarge it to accommodate the duplicate reeving system.

SUMMARY OF THE INVENTION

It is a general object of this invention to provide, in a gantry type crane, a reeving apparatus having a pair of winding drums and a plurality of ropes connected to the drums which normally operates with both drums and the entire plurality of ropes and is also operable with only one drum and less than the entire plurality of ropes.

This invention is accomplished by providing an overhead frame, a lifting beam positioned below the frame and carrying a plurality of rotatable lifting beam sheaves, and load carrying means suspended from the lifting beam. A plurality of ropes are also provided for supporting the lifting beam and load carrying means with each one of the plurality of ropes being wrapped around at least one of the plurality of lifting beam sheaves. A pair of rotatable drums are mounted on the overhead frame with the first drum being connected to the plurality of ropes for raising and lowering the lifting beam and the second drum also being connected to the plurality of ropes for raising and lowering the lifting beam. Although both drums are connected to the plurality of ropes, they are operable independently of each other to raise and lower the lifting beam in the event of inoperability of either one. Further, the pair of rotatable drums have a normal condition in which both are rotatably operable together to raise and lower the lifting beam.

Each of the plurality of ropes has an operating condition in which the rope is continuous and unbroken, and is affixed to both of the pair of drums. Each of the ropes may also have a failed condition in which the rope may, for example, be broken or detached from either one or both of the drums. However, the plurality of ropes, in response to rotation of either one or both of the pair of drums is operative to raise and lower the lifting beam with at least one of the ropes in a failed condition.

BRIEF DESCRIPTION OF THE DRAWINGS

Further objects and advantages of the invention will appear when taken in conjunction with the accompanying drawings, in which.

DESCRIPTION OF THE PREFERRED EMBODIMENT OF THE INVENTION

Figure 1:
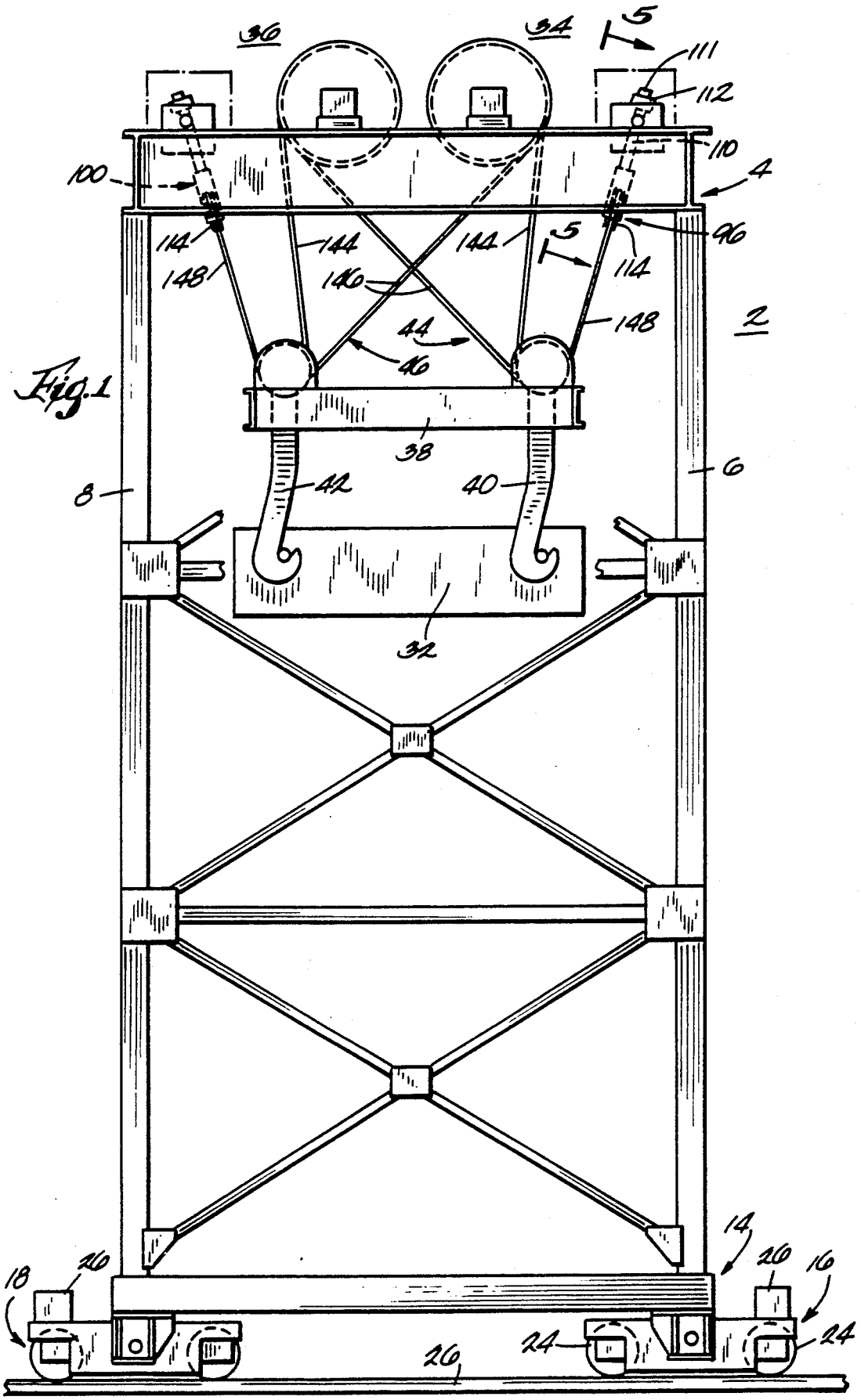
FIG. 1 is an end elevation view of a crane utilizing the reeving apparatus according to the invention.

Referring generally to FIGS. 1–4, a gantry crane having a frame 2 including an overhead frame section 4 mounted on legs 6, 8, 10 and 12 and a base section 14 supporting the legs 6, 8, 10, and 12. Wheel trucks 16, 18, 20 and 22 are attached to the base section 14 and each carry a plurality of wheels 24 and a wheel drive motor 26. The wheels 24 ride on the rails 28 and 30 which extend through an area in which objects such as load 32 to be raised, transported and lowered by the portal crane are located. The motors 26 drive a portion of the wheels 24 and thereby the portal crane so that it may move along the rails.

The crane further includes a pair of rotatable winding drums 34 and 36 mounted on the overhead frame 4, a lifting beam 38 positioned below the frame 4, load carrying hooks 40, 41, 42, and 43 affixed to the lifting beam 38 and extending downward from it for carrying the load 32. A plurality of ropes 44–51 are connected to the drums 34 and 36 and to the lifting beam 38 for supporting, raising and lowering the lifting beam and the load 32 as the drums 34 and 36 rotate to take up or pay out each of the ropes.

Figure 4:
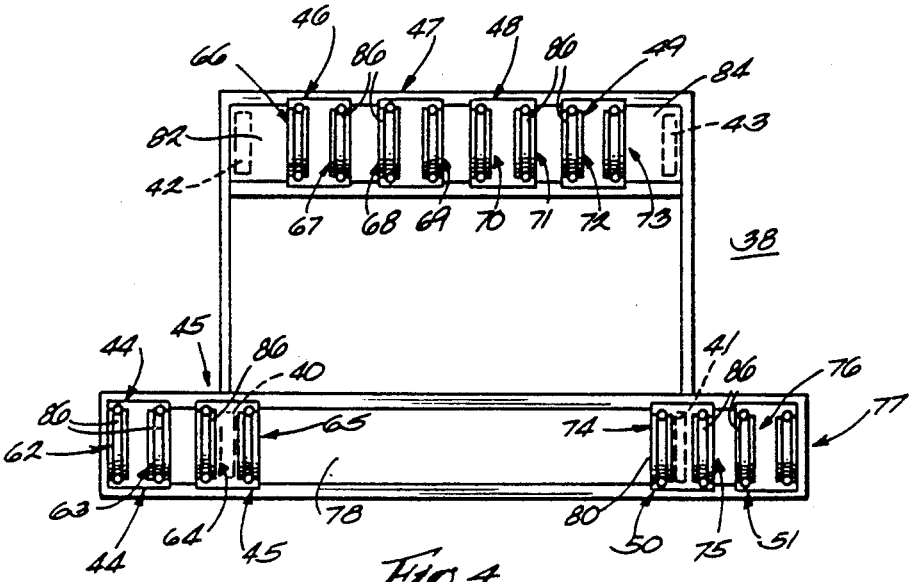
FIG. 4 is a plan view illustrating the lifting beam utilized in the reeving apparatus.

As can be seen in FIG. 4, the lifting beam 38 includes a plurality of sheaves, each adjacent pair of which correspond to each one of the ropes 44–51 and which are designated by the numerals 62–77. The lifting beam 38 includes horizontally spaced apart load supporting areas 78, 80, 82 and 84 as shown in FIG. 4 below which the hooks 40, 41, 42 and 43 respectively extend and adjacent to which the groups of sheaves 62–65, 74–77, 66–69, and 70–73 are positioned. As illustrated in FIG. 4, the groups of sheaves 62–65 and 74–77 are spaced apart from each other and rotatably mounted on a common axis and the groups of sheaves 66–69 and 70–73 are spaced apart from each other and rotatably mounted on a common axis which is spaced apart from the axis of the groups of sheaves 62–65 and 74–77. Each of the sheaves 62–77 includes a groove 86 for receiving in a wrapped around manner one of the ropes 44–51.

Figure 6:
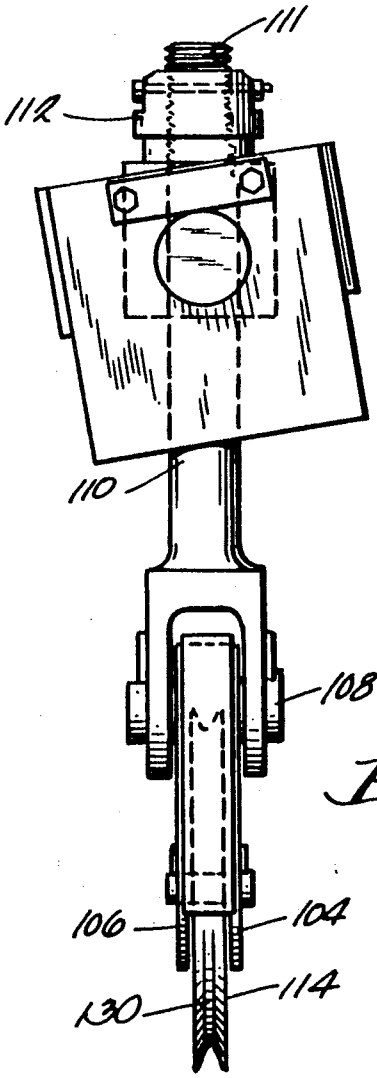
FIG. 6 is an end view of the equalizer sheave shown in FIG. 5.
Figure 5:
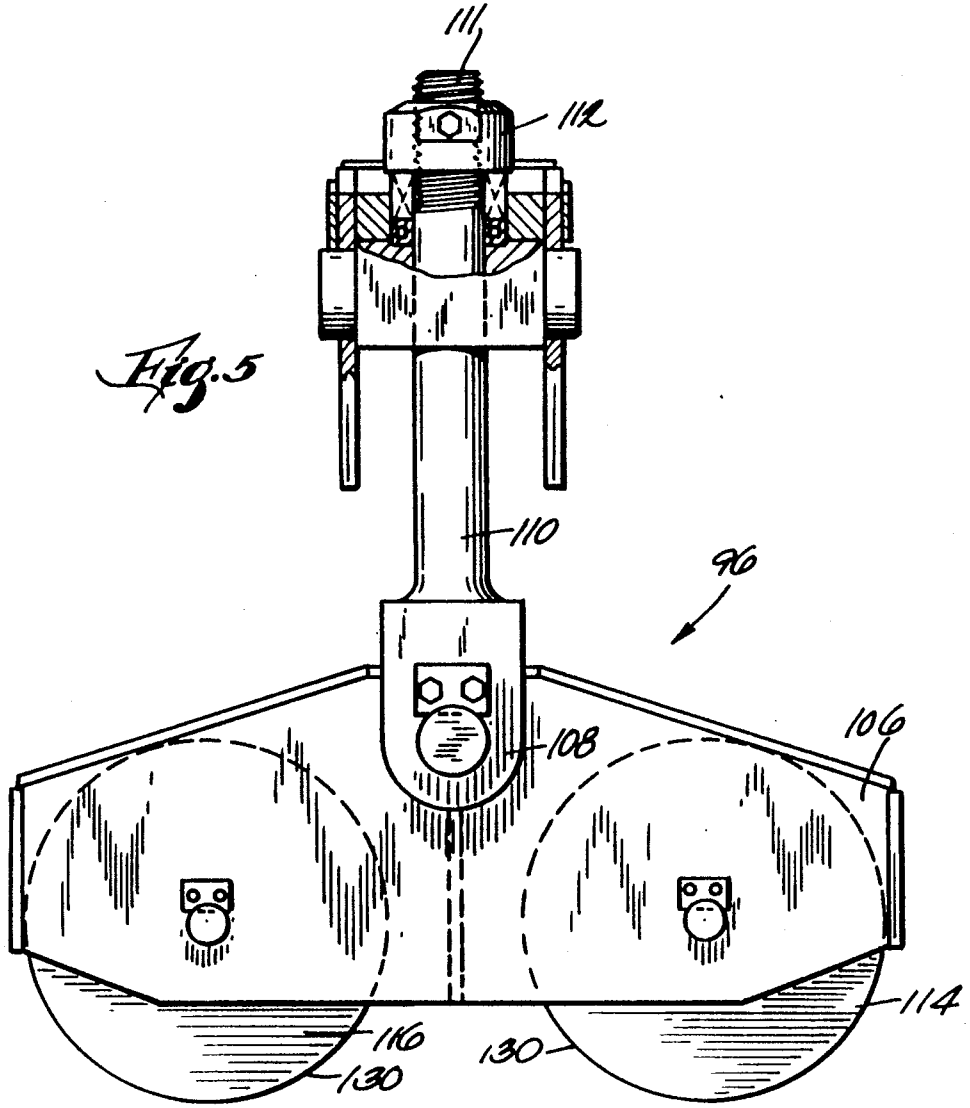
FIG. 5 is a cross sectional view taken along lines 5—5 of FIG. 1 illustrating an equalizer sheave assembly comprising part of the reeving apparatus.

The overhead frame section 4 includes equalizer assemblies 96, 98, and equalizer assemblies 100, 102, mounted outwardly on opposite sides of and in a direction transverse to the axis of the two drums 34 and 36. Each of the equalizer assemblies 96, 98 and 100, 102 are identical and thus only the equalizer assembly 96 will be described in detail. With reference to FIGS. 5 and 6, the equalizer assembly 96 comprises a pair of parallel plates 104, 106 which form a sheave block within which a pair of equalizer sheaves 114, 116 are rotatably mounted. Each sheave 114, 116 includes a groove 130. A shaft 110 having a threaded upper end 111 is pivotally connected to the plates 104, 106 by a pin 108. The shaft extends through the overhead frame section 4 and is affixed to the frame 4 by a nut 112 on the threaded end 111 to thereby affix the sheaves 114, 116 to the frame 4.

Figure 2:
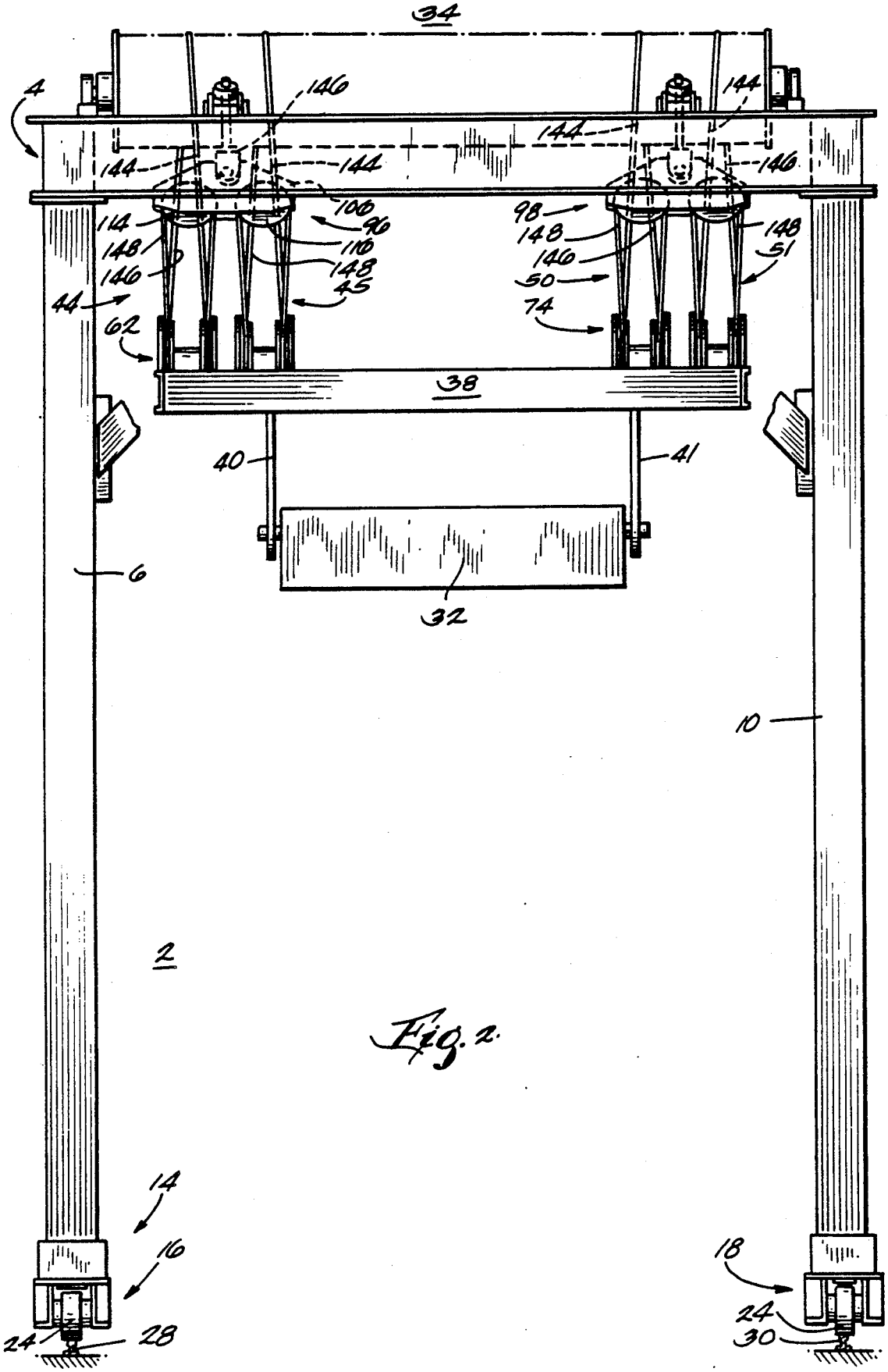
FIG. 2 is a side elevation view of the crane and reeving apparatus illustrated in FIG. 1.
Figure 3:
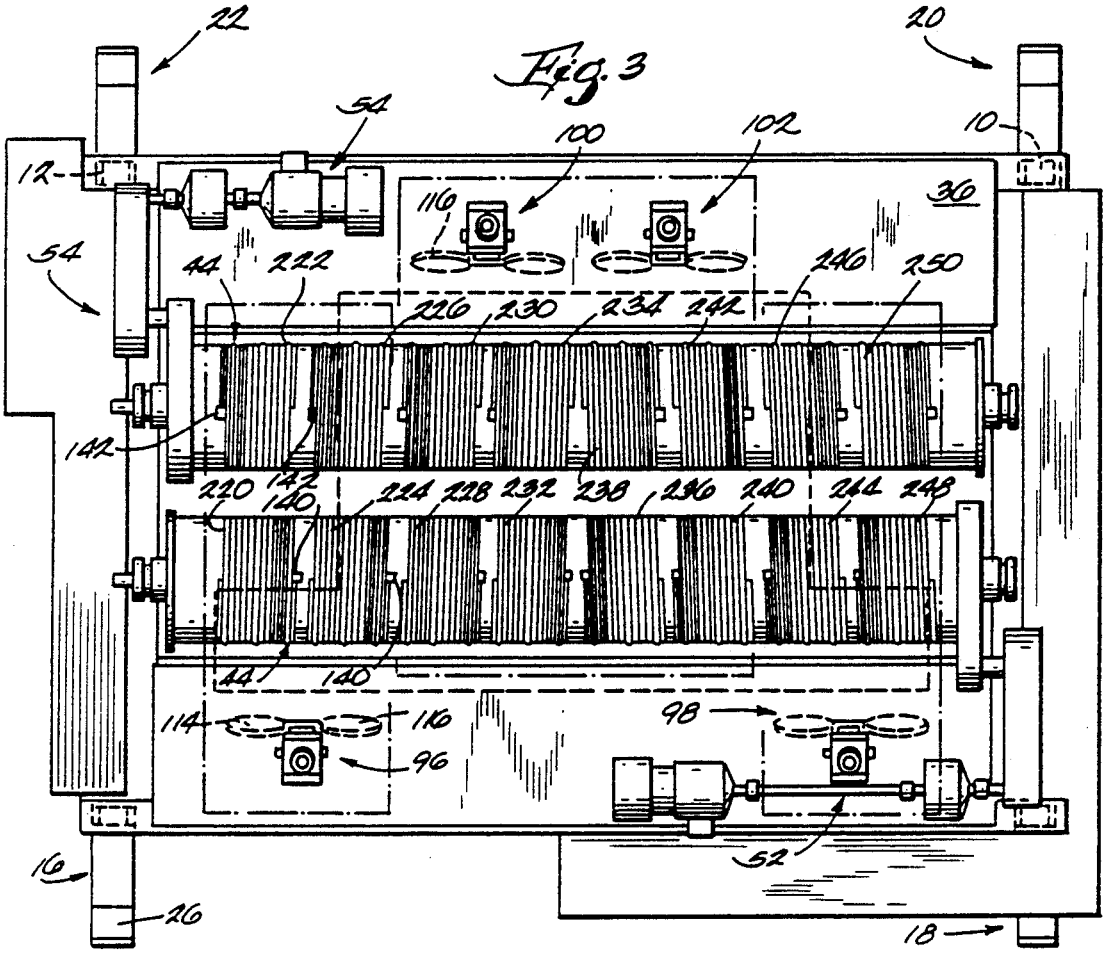
FIG. 3 is a plan view illustrating the rotating drums utilized in the reeving apparatus.

Each one of the ropes 44–51 has ends 140 and 142 respectively affixed to a circumferential surface of one of the drums 34 or 36. From one of the drums, each rope extends downwardly along an intermediate length portion 144 and wraps around one of the lower lifting beam sheaves 62–77 in a groove 86. The rope then extends upward along an intermediate portion 148 wrapped around an equalizer sheave 114 or 116 in a groove 130. From the equalizer sheave, the rope extends downwardly to an intermediate portion 146 which is wrapped around a lower lifting beam sheave most adjacent the other lifting beam sheave wrapped by the rope and which then extends upwardly to the other drum. As shown in FIG. 4, each pair of ropes such as ropes 44 and 45 respectively wrap around adjacent lifting beam sheaves such as sheaves 62, 63, and 64, 65 at only one of the load supporting areas 78, 80, 82, or 84. Also, as shown in FIG. 2, each pair of ropes such as ropes 44 and 45 extend up to and wrap around one of the pair of equalizer sheaves 114 or 116. Each pair of ropes and the adjacent lifting beam sheaves about which they wrap may be considered as one reeving unit which provides the only support for the lifting beam 38 at the load supporting area to which the group of sheaves for that reeving unit are adjacent. Thus, in the illustrated embodiment of the invention and as shown in FIG. 4, there are four reeving units each of which provide the only lifting beam support at load supporting areas 78, 80, 82, and 84.

The drum 34 is rotatably driven and controlled by a motor and brake 52 independently of the drive and control for the drum 36 and the drum 36 is driven and controlled by a motor and brake 54 independently of the drive and control for drum 34. In raising and lowering the lifting beam 38 and load 32, the drums 34 and 36 have a normal operating condition in which either drum rotates at the same rotational speed but in opposite directions to perform the raising and lowering operation. The drum 34 has circumferential surface grooves 220, 224, 228, 232, 236, 240, 244 and 248 and the drum 36 has circumferential surface grooves 222, 226, 230, 234, 238, 242, 246, and 250 for receiving and guiding the ropes 44–51 as they are wound onto or off of the drums.

In operating to lower the hooks 40–43 to pick up a load 32, the drum 34 is rotated in a clockwise direction and the drum 36 is rotated in a counter-clockwise direction. The ropes 44–51 will be paid out from the drums 34 and 36 and guided by the circumferential grooves due to the weight on the ropes of the lifting beam 38, the hooks 40–43 and any load 32 carried by the hooks. In being paid out from the drums 34 or 36, those ropes 44, 45 and 50, 51 located or wrapped around sheaves positioned in the load supporting areas 78 and 80 of the lifting beam 38 having their intermediate portions, such as portions 144 and 146 of rope 44, are paid out at the same rate. However, because of the different distance between the drums and the lifting beam sheaves that the rope portions 144 and 146 span, as can best be seen in FIG. 1, the amount of downward movement by the lifting beam 38 permitted by the paying out of the rope portion 146 is less than that permitted by the paying out of the rope portion 144. The differing spans of the rope portions 144 and 146 of rope 46 and the other ropes wrapping around lifting beam sheaves located in load lifting areas 82 and 84 presents the same lowering distance problem. This problem is accommodated by the use of the equalizer assemblies 96, 98, 100 and 102 which permit rope movement between the rope portions 144 and 146 to thereby equally maintain the tension on the rope portions 144 and 146 as the lifting beam 38 and load 32 are lowered. In raising the lifting beam 38 and the load 32, the drum 34 is rotated in a counter-clockwise direction and the drum 36 is rotated in a clockwise direction, relative to the view of FIG. 1, both at the same rotational speed. In raising the lifting beam and the load, the equalizer assemblies again act to equalize the tension on the rope portions such as portions 144 and 146. The pairs of ropes, such as ropes 44 and 45, which wrap around lower sheaves 62, 63, and 64, 65 on lifting beam 38 and around upper equalizer sheaves 114, 116 also have the load or tension of the lifting beam 38 and load object 32 equalized by pivotal movement of the sheave block about pin 108.

In the event of inoperability of either one of the winding drums 34 or 36, the other one of the two drums can be operated to raise and lower the lifting beam 38 and the load 32. This is possible since the opposite ends of the ropes 44–51 are affixed to the two drums 34 and 36, so that the two drums act as dead-ends for the opposite ends of each rope. As a result, either drum can be rotated to wrap all of the ropes 44–51 onto its circumferential surface grooves to apply raising force at each one of the load lifting areas 78, 80, 82 and 84 to raise the lifting beam 38 and the load 32. Since the drums 34 and 36 are independently driven by separate motor and brake units 52 and 54, failure of either one will not disable the other motor and brake unit. Furthermore, the circumferential groove on each drum 34 and 36 for each one of the ropes 44–51 has a groove length that will accept the maximum length of the rope that will be wound onto the drum if that drum is the only drum operating to raise and lower the lifting beam 38 and its load.

In the event that any one of the ropes 44–51 wrapping around a sheave in one of the sheave groups 62–65, 66–69, 70–73 or 74–77 breaks, the second rope at that sheave group location will continue to support the load so that the operation of the drums, reeving system and lifting beam can continue. This is also true if a single rope in each one of all of the sheave groups 88, 90, 92 and 94 breaks, although the capacity of the crane hoist will be limited. In the event of failure of one of the pair of ropes of a reeving unit, such as ropes 44 and 45, the sheave block comprising plates 104, 106 will pivot about pin 108 to decrease the load on the rope remaining in an operating condition. If both of a pair of ropes of one reeving unit fail, such as ropes 44 and 45, the lifting beam 38 and load 32 will continue to be supported by the ropes and sheave groups of the other three reeving units at the other three load supporting areas 80, 82, and 84 to permit the lifting beam and winding drum raising and lowering operation to continue.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. A reeving apparatus for a crane having an overhead frame, rotatable winding drum means mounted on the frame, a lifting beam positioned below the frame, and load carrying means suspended from the lifting beam, comprising:

a plurality of rotatable lower sheaves affixed to the lifting beam;

the lifting beam includes a plurality of load supporting locations and at least two of said plurality of lower sheaves are positioned adjacent each load supporting location of the lifting beam;

at least one equalizer assembly mounted on the overhead frame and including a pair of upper sheaves and sheave block means, the pair of upper sheaves being rotatably mounted on the sheave block means and the sheave block means being pivotally mounted on the overhead frame at a pivot position on the sheave block means between the pair of upper sheaves;

rope means affixed to the winding drum means for supporting and raising and lowering the lifting beam and load carrying means, the rope means including a plurality of ropes, each one of the plurality of ropes wrapping one of the plurality of lower sheaves, first and second ropes of the plurality of ropes, extending from a pair of lower sheaves positioned adjacent to a load supporting location up to and respectively wrapping around one of the pair of upper sheaves on the sheave block means of the equalizer assembly; and the sheave block means is pivotally movable about said pivot position to equalize the load between said first and second ropes.

2. The reeving apparatus according to claim 1, wherein:

each one of the first and second ropes has an operating and a failed condition; and the sheave block means is pivotal in a direction to decrease the load on the one of the first and second ropes in an operating condition when the other of the first and second ropes is in a failed condition.

* * * * *